United States Patent [19]

Vaughn

[11] Patent Number: 4,514,880

[45] Date of Patent: May 7, 1985

[54] FORMATION OF NONWOVEN WEBS OR BATTS FROM CONTINUOUS FILAMENT TOW OR YARN STRANDS

[75] Inventor: Edward A. Vaughn, Clemson, S.C.

[73] Assignee: Allied Corporation, Morristown, N.J.

[21] Appl. No.: 472,829

[22] Filed: Mar. 7, 1983

[51] Int. Cl.[3] ..... D01G 1/08

[52] U.S. Cl. ..... 19/0.35; 19/0.48; 19/0.51; 19/34

[58] Field of Search ..... 19/0.3, 0.35, 0.37, 19/0.39, 0.41, 0.43, 0.46, 0.48, 0.51, 0.56, 145.7, 304

[56] References Cited

U.S. PATENT DOCUMENTS

| | | | |
|---|---|---|---|
| 2,104,827 | 1/1938 | Taylor et al. | 19/0.35 |
| 2,523,854 | 9/1950 | Woods | 19/0.35 X |
| 2,797,444 | 7/1957 | Takagi et al. | 19/0.35 X |
| 2,948,021 | 8/1960 | Bailiff | 19/0.35 X |
| 3,065,614 | 11/1962 | Labino | 19/0.48 X |
| 3,403,425 | 10/1968 | Tajinia et al. | 19/0.51 |
| 3,789,461 | 2/1974 | Nakano et al. | 19/0.35 |
| 3,918,126 | 11/1975 | Wood | 19/145.7 X |
| 4,355,438 | 10/1982 | Reeves et al. | 19/0.51 |

FOREIGN PATENT DOCUMENTS

| | | | |
|---|---|---|---|
| 748434 | 5/1956 | United Kingdom | 19/0.48 |

*Primary Examiner*—Louis K. Rimrodt

*Attorney, Agent, or Firm*—Ken C. Decker; William N. Antonis

[57] ABSTRACT

A method and machine for forming nonwoven batts containing refractory fibers such as carbon, glass, ceramic or metallic fibers, includes a conveying table (12) provided with scalloped rollers (90, 92) which separate tows of filaments (16) and spread the filaments on a conveying table. A feed roller (80) holds the filaments on the table so that they are conveyed to a rotating lickerin (60). The lickerin (60) is provided with teeth (62) which grasp the filaments so that a tensile force is applied thereto, thereby breaking the filaments at structurally weak points in the filaments. The fibers are mixed with textile fibers and transferred to a foraminous condenser (144) by blowing the fibers through a duct (112). The fibers are arranged on the conveyor (114) in a random fashion to form a batt.

8 Claims, 3 Drawing Figures

FORMATION OF NONWOVEN WEBS OR BATTS FROM CONTINUOUS FILAMENT TOW OR YARN STRANDS

This invention was made with Government support under Contract No. DAAK60-80-C-0091, awarded by the Department of the Army. The Government has certain rights in this invention.

This invention relates to a method and machine for forming nonwoven webs or batts containing fiber mixtures including refractory fibers such as carbon, glass, ceramic or metallic fibers.

Nonwoven batts made from mixtures of textile or wood pulp and refractory fibers have many uses. For example, batts containing carbon fibers may be used in protective garments. Batts containing carbon and glass fibers are often used in filters. Batts made from any of these materials have been proposed for use as a skeletal material which, when impregnated with the appropriate resin, can be molded into structural composites. However, batts containing these refractory fibers have been difficult to manufacture, since these fibers tend to agglomerate in bundles and the batts formed therefrom tend to be irregular and lack cohesiveness. Furthermore, some of these fibers, such as carbon fiber, tend to powder so that only discontinuous batts with nonuniform fiber distributions can be produced.

Prior art techniques for forming nonwoven batts are exemplified by the method and machine disclosed in U.S. Pat. No. 3,918,126 (Wood) issued Nov. 11, 1975, and assigned to the Rando Machine Corporation. This device includes a large hopper in which fibers which have been cut to arbitrary lengths are placed. The fibers are then lifted by a spiked elevating apron to a delivery station where a predetermined amount of fiber is removed by metered air flow. The fibers are then consolidated into a feed mat by air flow through a condenser screen. The feed mat is transferred to mechanical rolls and metered by a feed roll, and is then passed over an elongated serrated nose bar and brushed off by a wire-wound, toothed lickerin. Air flow then doffs the fibers from the tips of the lickerin and conveys the fibers to a foraminous conveying aron, where the batt is formed. As discussed above, however, when, for example, carbon filaments were cut to arbitrary lengths and placed in the hopper, an unacceptable high percentage of the fibers turned into dust, and acceptable batts could not be made economically.

The present invention, instead of cutting the filaments into arbitrary lengths, feeds, for example, carbon fibers to the rotating lickerin in continuous strands. The carbon filaments are caught by the lickerin and a tensile force is applied to the filaments, which breaks the carbon filaments into carbon fibers at weak points in the filaments. In retrospect, it is believed that chopping the filaments into arbitrary lengths as was done in prior art processes permitted the fibers to fracture again during processing at inherent weak points in the fibers, thereby producing powder. By pulling the filaments apart by applying a tensile force thereto, the filaments are broken at the weak points in their structure, so that the fibers do not break again and turn into powder as they are formed into a batt.

Accordingly, the present invention has the advantage of forming batts incorporating refractory fibers such as carbon, glass, ceramic or metallic fibers on a continuous basis with a uniform distribution of the fibers, while minimizing powdering of the fibers.

These and other advantages of the present invention will become apparent with reference to the following description and the accompanying drawings, in which.

Figure 1:
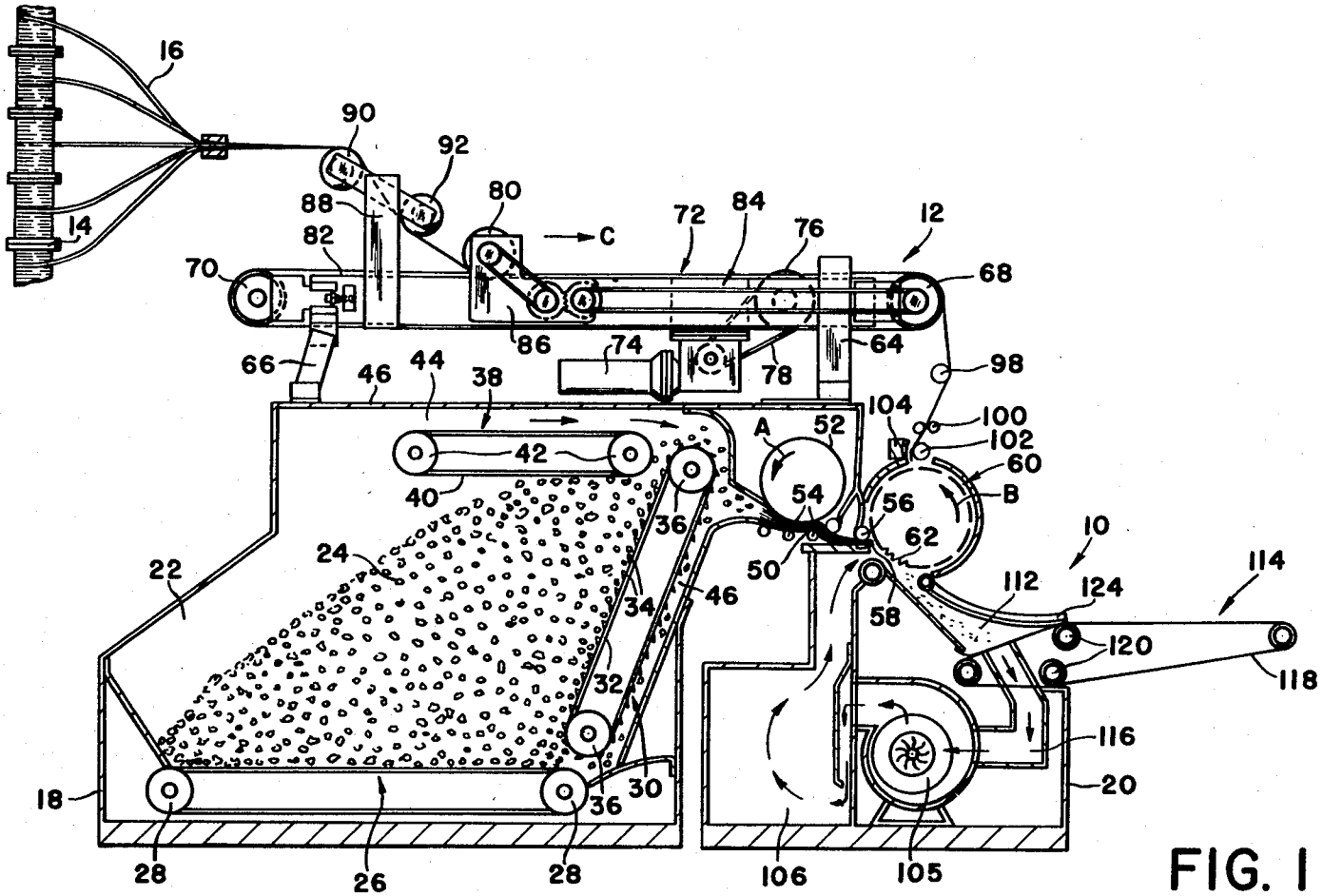
FIG. 1 is a cross-sectional view illustrating schematically an air laid non-woven batt formation machine which uses my present invention.
Figure 3:
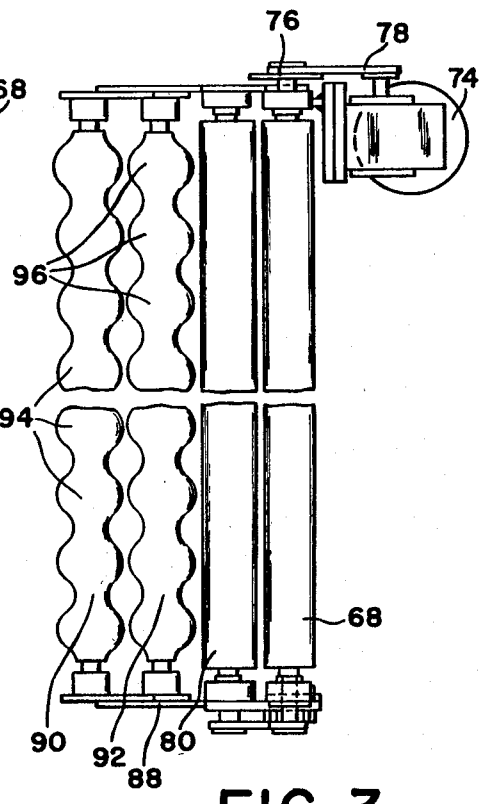
FIG. 3 is a side elevational view of FIG. 2.

Referring now to the drawings, an air laid non-woven batt formation machine generally indicated by the numeral 10, of the type available commercially from the Rando Machine Corporation and generally illustrated in the aforementioned U.S. Pat. No. 3,918,126, is provided with a conveying mechanism 12 which feeds carbon filaments to the machine 10 from spools 14 (or other such packages) of carbon tow 16. Each spool of carbon tow 14 comprises a bundle of filaments loosely bundled together and wrapped on the spools 14. Although carbon tow is illustrated, the spools 14 may contain other refractory filaments, such as fiberglas, or ceramic or metallic filaments.

The machine 10 includes housings 18, 20. The housing 18 defines a large hopper 22 therewithin for receiving tufts of, for example, textile fibers 24. A conveying apron 26 is mounted on rollers 28 and operated by an appropriate power source (not shown) to move the tufts 24 to the right viewing FIG. 1 toward an elevating apron generally indicated by the numeral 30. The elevating apron 30 comprises an endless belt 32 provided with spikes 34. The belt 32 is wrapped around powered rollers 36, so that the belt 32 conveys the tufts upwardly viewing FIG. 1. A stripper apron generally indicated by the numeral 38 includes an endless belt 40 wrapped around powered rollers 42. A blower (not shown) provides metered air flow through the channel 44 defined between the upper portion 46 of the housing 18 and the upper race of the belt 40. The metered air flow through the channel 44 removes a predetermined quantity of the tufts 24 from the elevating apron 30. The remaining tufts are returned to the hopper 22 through the channel 46. The metered air flow passing through channel 44 forces the tufts into a duct 48.

The fibers are then consolidated into a feed mat 50 by the air flow flowing through the channel 44 and the duct 48. This air flow enters a porous condenser screen 52, which rotates in the direction indicated by the arrow A. The mat is formed between the screen 52 and mechanical rolls 54. The feed mat 50 is transferred by the mechanical rolls 54 to a feed roll 56, and is then passed over a conventional serrated nose bar 58. The fibers are brushed off the nose bar 58 by a conventional lickerin generally indicated by the numeral 60. The lickerin 60 is provided with a serrated surface defining spikes or teeth 62 across the entire width and around the circumference of the lickerin 60. The lickerin 60 is powered for rotation as indicated by the arrow B in FIG. 1.

The conveying mechanism 12 is supported above the machine 10 on supports 64, 66. Rollers 68, 70 are rotatably supported on the supports 64, 66 respectively, with the roller 68 being supported over the lickerin 60. An endless conveyor belt 72 wraps around the rollers 68, 70. The belt 72 is driven in the direction indicated by the Arrow C by a motor 74 which drives the roller 68 through pulley 76 and drive belt 78. A feed roller 80 is mounted across the upper race 82 of the belt 72 for engagement with the latter and is driven by the motor 74 through the drive belt 78, and the pulley, gear and drive belt mechanism generally indicated by the numeral 84 mounted with the feed roll 80 on a bracket 86. The bracket 86, and the motor 74 are supported by the supports 64, 66. Another bracket 88 extends vertically from the race 82 of the belt 72 and rotatably supports a pair of rollers 90, 92 which are vertically and horizontally offset from one another. The roller 90 is provided with scallops or serrations 94 and the roller 92 is provided with scallops or serrations 96.

Before reaching the lickerin 60, the carbon filaments pass over the end of the roll 68 and are guided by guide rollers 98, 100 to a feed roll 102 which cooperates with an elongated nose bar 104. The feed roll 102 and the nose bar 104 are similar to the rotating feed roll 56 and nose bar 58. The carbon fibers are mixed with the textile fibers and are doffed by the centrifugal forces generated by the rotating speed of the lickerin 60 and also by air flow provided by a blower 105. The blower 105 blows air into a chamber 106 defined within the housing 20, which is guided through a duct 110 past a saber 108, and into a duct 112 which extends from the lickerin 60. The blended textile and, for example, carbon fibers are removed from the lickerin and are conveyed by the air stream provided by the blower 105 through the duct 112 to a foraminous conveyor generally indicated by the numeral 114. The inlet of the blower 105 is connected to a duct 116 which communicates with the duct 112 through the foraminous belt 118 comprising a part of the conveying mechanism 114. Since the belt 118 is porous and permits air flow therethrough, the blower 105 is capable of circulating air through the ducts 112, 116, chamber 106 and duct 54. The screen or conveyor 118 is mounted on guide rollers 120 which are driven by a motor (not shown). As will be discussed in detail hereinafter, the nonwoven web or mat is formed on the foraminous conveyor 118, which includes the portion 122 extending from the duct cover 124 to permit ready removal of the batt as it is formed.

Figure 2:
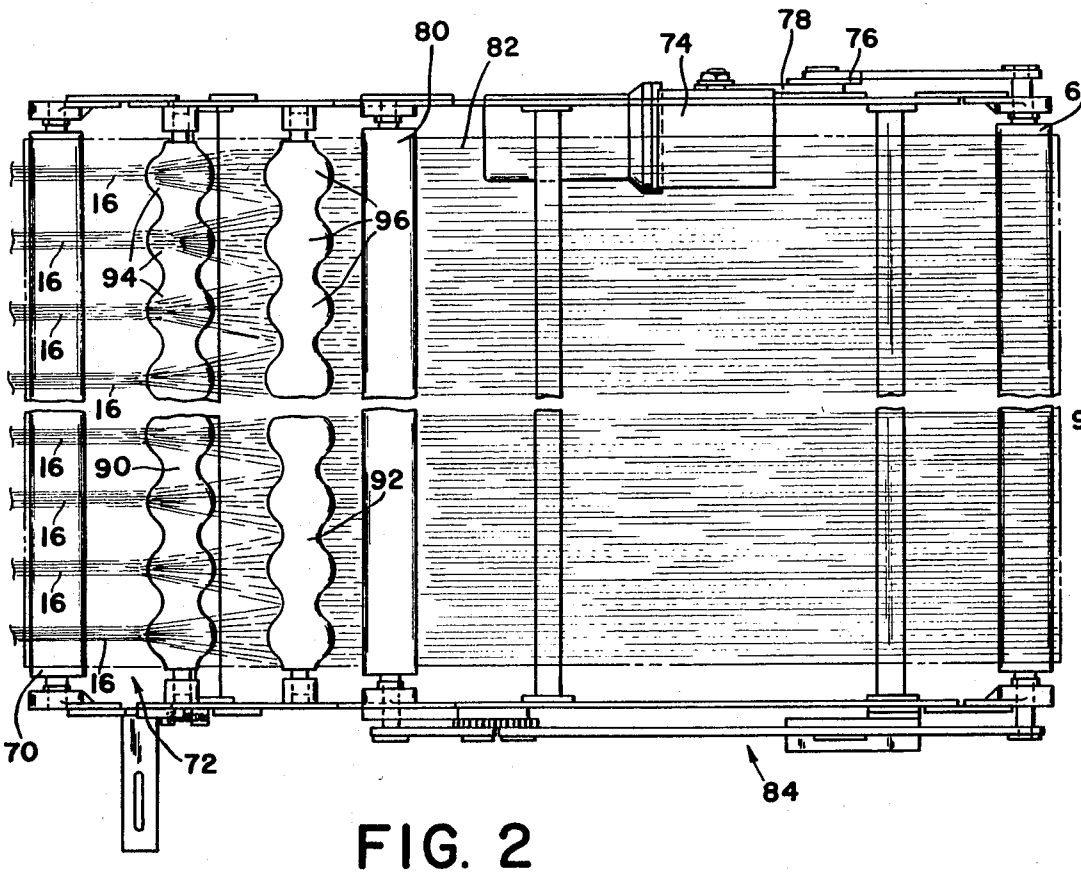
FIG. 2 is a top plan view of the conveying apron used in the machine of FIG. 1.

In operation, carbon tow 14 is fed from the spools 16 over the roller 90 and under the roller 92 as most clearly illustrated in FIG. 1. As shown in FIG. 2, the scallops or serrations, 94, 96 on the rollers 90, 92 tend to spread the filaments of each of the tows 14 so that each filament is spread on the race 82 of the conveyor belt 72. The filaments pass under the feed roll 80 which, because it is driven at the same speed as the belt, holds the filaments against the belt and makes sure that they travel at the same speed as the belt towards the rotating lickerin 60. The individual filaments form, as indicated in FIG. 2, a band extending all the way across the conveying mechanism 12 and are fed over the end thereof and across the rollers 98 and the feed roller 102 and nose bar 104 to the rotating than the surface speed at which the conveyor belt 72 is driven by the motor 74. Because of the serrations 62 on the surface of the lickerin 60, the lickerin 60 grasps the filaments and thereby exerts a tensile force on the filaments. Accordingly, since the feed roll 80 holds the filaments on the conveying table 72, the tensile force will pull the filaments apart at weak points in the filaments. The length of each fiber pulled off by the lickerin will, of course, vary due to the differences in structure of the filaments, since weak points in some filaments will occur at different places than weak points in other filaments. In any event, the carbon fibers are mixed with textile fibers fed to the lickerin through nose bar 58 and feed roll 56. As discussed hereinabove, the mixture of carbon filaments and textile filaments are doffed from the lickerin 60 by centrifugal forces generated by rotation of the lickerin, and also by the air stream provided by the blower 105. The mixed carbon and textile fibers are blown through the duct 112 by the air stream provided by the blower 105 and are condensed on the portion 124 of the screen 118 which is exposed to the duct 112. Since the screen 118 is rotated around the rollers 120, the mat eventually exits from the duct 112 on the screen 118, which then becomes another portion 120 of the screen 118 so that the batt may be removed.

I claim:

1. Method of forming continuous batts of random fibers comprising the steps of breaking individual filaments bundled into tows at relatively weak points in the filament into segments which are relatively short but of random length by separating said tows into individual filaments, arranging said filaments on a conveying table in a substantially parallel arrangement, holding said filaments against said conveying table while maintaining said relatively parallel arrangement of the filaments on the conveying table, using said conveying table to move said filaments in said substantially parallel arrangement toward a rotating lickerin, rotating said lickerin at a surface speed greater than the surface speed of the conveying table, causing said lickerin to grasp said filaments, and, due to the greater surface speed of said lickerin, applying said tensile force to said filaments to break the latter into said segments, doffing said segments from the lickerin, and depositing said segments on a condenser.

2. Method as claimed in claim 1, wherein said filaments are held against said conveying table by a roller rotated at a surface speed substantially the same as that of the table.

3. Method as claimed in claim 1, wherein said segments of said filaments are deposited on said condenser by blowing said short lengths through a duct.

4. Method as claimed in claim 1, wherein said filaments are separated from the tows and arranged on said conveying table by feeding said tows through a pair of serrated rollers.

5. Machine for forming a random web comprising a rotating lickerin, a conveying table driven at a predetermined surface speed for feeding filaments to said lickerin, means on said lickerin for grasping the filaments to apply a tensile force thereto as the filaments are fed to the lickerin to break said filaments at a structurally weak point in the filament between the lickerin and the grasping means, means to drive said lickerin at a surface speed greater than the surface speed of the conveying table, said filaments being fed to the conveying table in tows, and means for separating the tows into individual filaments and arranging the filaments in a substantially parallel relationship on said conveying table, and a feed roller located over said conveying table and holding said filaments against said conveying table as the filaments are fed toward the lickerin to permit the lickerin to apply said tensile force to the filaments.

6. Machine according to claim 5, wherein said filaments are made of carbon, and means to feed fibers other than carbon fibers to said lickerin to combine with the carbon filaments.

7. Machine according to claim 5, wherein said grasping means is a toothed surface on the lickerin.

8. Machine according to claim 5, wherein said separating means includes a pair of serrated rollers, said tows being fed between said rollers which separate the individual filaments from one another and guide the latter onto the conveying table.

* * * * *